US006097904A

United States Patent [19]

Tsuruno et al.

[11] Patent Number: 6,097,904

[45] Date of Patent: Aug. 1, 2000

[54] CONTROL APPARATUS FOR ENERGIZING HEATING ELEMENT

[75] Inventors: Kunio Tsuruno; Koki Kuroda, both of Tokyo; Masayoshi Taira, Kashiwa, all of Japan

[73] Assignee: Canon Kabushiki Kaisha, Tokyo, Japan

[21] Appl. No.: 09/021,458

[22] Filed: Feb. 10, 1998

[30] Foreign Application Priority Data

Feb. 13, 1997 [JP] Japan ..... 9-029133
Feb. 28, 1997 [JP] Japan ..... 9-062352

[51] Int. Cl.[7] ..... G03G 15/20; H05B 1/02; H05B 3/62

[52] U.S. Cl. ..... 399/33; 219/494; 219/497; 219/507

[58] Field of Search ..... 219/216, 492, 219/493, 497, 499, 507; 340/328, 330; 399/328, 330, 33

[56] References Cited

U.S. PATENT DOCUMENTS 4,500,775 2/1985 Sangu et al. ..... 219/497
4,656,338 4/1987 Yagasaki et al. ..... 219/497
4,740,671 4/1988 Kuroda et al. ..... 217/492
5,464,964 11/1995 Okuda et al. ..... 219/497

*Primary Examiner*—Arthur T. Grimley
*Assistant Examiner*—Hoang Ngo
*Attorney, Agent, or Firm*—Fitzpatrick, Cella, Harper & Scinto

[57] ABSTRACT

In order to separately detect an abnormal temperature rise at a fixing roller of an image forming apparatus and a disconnection of a thermistor that detects the temperature of the fixing roller, the first and the second resistors are selected and connected to a thermistor for predetermined periods of time. When the first resistor is connected to the thermistor, a disconnection of the thermistor is detected based on a detection voltage that corresponds to the voltage division ratio of the reading for the first resistor to the reading for the thermistor. When the second resistor is connected to the thermistor, an abnormal temperature rise of the fixing roller is detected based on a detection voltage that corresponds to the voltage division ratio of the reading for the second resistor to the reading for the thermistor.

14 Claims, 13 Drawing Sheets

CONTROL APPARATUS FOR ENERGIZING HEATING ELEMENT

BACKGROUND OF THE INVENTION

1. Field of the Invention

The present invention relates to an apparatus for controlling energization of a heating element, such as a heater.

2. Related Background Art

Conventionally, a so-called electrophotographic image forming apparatus comprises: an image forming unit, for forming a toner image on a photosensitive drum and transferring the toner image to a recording medium (sheet member) to form an image on its surface; and a fixing unit, located below, for heating the toner image formed on the recording medium so as to fix the toner to its surface.

The temperature at the heating section of the fixing unit is controlled so that a constant heat quantity is transmitted to the recording medium. A temperature detector, such as a thermistor, controls the temperature of the heating section. However, a disconnection of the thermistor and an abnormal temperature rise at the heating section can not be identified as separate malfunctions, and are detected as the same abnormality because the thermistor has a negative temperature coefficient.

When an abnormality signal is generated at the thermistor, therefore, it is impossible to immediately determine whether it is for a disconnection or for an abnormal temperature rise. The abnormality can not be handled until the cause is found by checking the wiring and the temperature.

Furthermore, the conventional image forming apparatus employs, as a safety mechanism for preventing the temperature of a fixing roller from exceeding a set temperature, a high temperature detection thermistor in addition to a temperature control thermistor, or an energizing controller having a temperature switch connected in series with a heater to halt the energization of the heater when a temperature rises unexpectedly high.

However, in the energizing controller of the conventional image forming apparatus, when the temperature switch is activated as a safety mechanism in the event an operating failure occurs in a temperature control thermistor, the operating speed of the temperature switch is slower than is that of the thermistor, so that heat hysteresis continues to affect the fixing roller and an image forming problem occurs.

Also employed is a mechanism for detecting, as a temperature detection abnormality, the failure of the temperature of the temperature control thermistor to rise, even though a heater energizing signal is received, and for halting the energization of a heater. With this mechanism, however, the magnitude of the detected temperature error is increased by the entrance of a foreign substance between a temperature control thermistor and a fixing roller, so that heat hysteresis continues to affect the fixing roller and an image forming problem occurs.

SUMMARY OF THE INVENTION

It is, therefore, one object of the present invention to provide an energization control apparatus that eliminates the above problems.

It is another object of the present invention to provide an energization control apparatus that can separately detect an abnormality in a temperature detection device and an abnormal temperature rise in a heating element.

It is an additional object of the present invention to provide an energization control apparatus that prevents heat hysteresis from having a continuing effect on an object to be heated by a heating element.

Other objects of the present invention will become apparent during the course of the description of the preferred embodiments given while referring to the accompanying drawings and from the descriptions given in the claims.

DETAILED DESCRIPTION OF THE PREFERRED EMBODIMENTS

The preferred embodiments of the present invention will now be described while referring to the accompanying drawings.

[First Embodiment]

Figure 1:
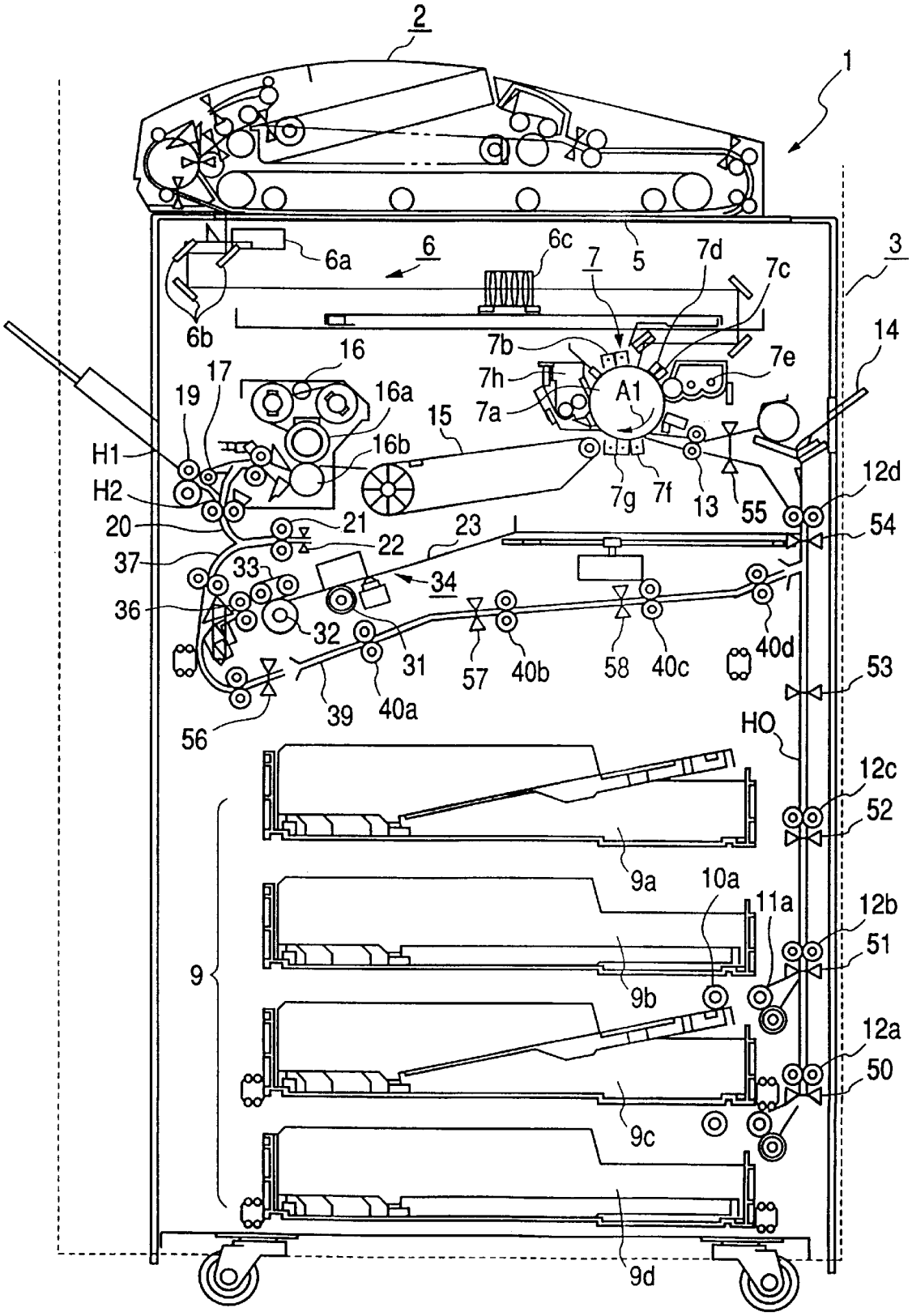
FIG. 1 is a schematic diagram for explaining the arrangement of an image forming apparatus according to a first embodiment of the present invention.

FIG. 1 is a schematic diagram illustrating the arrangement of an electrographic copying machine, an image forming apparatus according to a first embodiment of the present invention. A copying machine 1 in FIG. 1 comprises a circulating automatic feeder (hereinafter referred to as an RDF) 2 for automatically feeding a document, and an image forming main body (hereinafter referred to as a main body) 3. The RDF 2 can be freely assembled with the main body 3.

A document table glass 5 is mounted at the top of the main body 3. An optical system 6, located below the document table glass 5, comprises an exposure lamp 6*a*, a scanning mirror 6*b*, a zoom lens 6*c* and a motor (not shown). A document is exposed by the exposure lamp 6*a*, and the light reflected from the document is projected onto a photosensitive drum 7*a* by the scanning mirror 6*b* and the zoom lens 6*c*.

An image forming unit 7, located below the optical system 6, includes the photosensitive drum 7*a*, which is rotatable in the direction indicated by an arrow A1, and a high pressure unit 7*b*, a blank exposure unit 7*c*, a potential sensor 7*d*, a developer 7*e*, a transfer charger 7*f*, a separator charger 7*g* and a cleaner 7*h*, all of which are provided around the photosensitive drum 7*a* in its rotational direction.

The photosensitive drum 7*a* is driven by a main motor (not shown) and is corona-charged by the high pressure unit 7*b*. The photosensitive drum 7*a* is irradiated by the optical system 6 using the light reflected from the document, and an electrostatic latent image is thus formed thereon. The electrostatic latent image is developed by the developer 7*e* so as to be visually provided as a toner image.

Paper cassette unit 9, consisting of a first cassette 9*a*, a second cassette 9*b*, a third cassette 9*c* and a fourth cassette 9*d*, is provided at the lower portion of the main body 3.

A paper feeder is provided for each cassette to feed sheets S that are mounted thereon as recording media. In the schematic arrangement of, for example, the paper feeder for the third cassette 9*c*, a feeding roller 11*a*, for continuing to feed the sheet S, and a pickup roller 10*a* are provided at the distal end of the upper portion of the third cassette 9*c*.

Furthermore, downstream of the rollers 10*a* and 11*a*, conveying rollers 12*a*, 12*b*, 12*c* and 12*d*, which are provided along a vertical transportation path H0, supply the sheet S to the image forming unit 7, so that the sheet S is transported to resist rollers 13 located in the vicinity of the image forming unit 7. A multiple manual paper feeding section 14 is located near the image forming unit 7 for the manually feeding of a sheet S to the image forming unit 7.

A conveying belt 15 is located downstream from the image forming unit 7 to transport downstream the sheet S to which an image is transferred, and a fixing unit 16, which is located downstream along the conveying belt 15, uses heat to fix the toner image to the surface of the sheet S.

The fixing unit 16 comprises a fixing roller 16*a*, which is heated at a predetermined fixing temperature, and a lower roller 16*b* for contacting the fixing roller 16*a*. The fixing unit 16 uses heat to fix the toner image to the surface of the sheet S that is transported from the image forming unit 7 along the convey belt 15.

In this embodiment, a thermistor (not shown) contacts the fixing roller 16*a* and serves as temperature detection means for controlling the temperature of the fixing roller 16*a*.

In the vicinity of the fixing unit 16 are provided a path H2, along which the sheet S is to be transported for double-sided printing and for multiple printings; a path H1, along which the sheet S is to be discharged to the outside of the main body 3; and a discharge flapper 17 for switching between the paths H2 and H1. Paired discharge rollers 19 are provided along the paper discharge path H1.

A path 20, along which the sheet S is transported for double-side printing and for multiple copying, is provided below the fixing unit 16. Downstream of the path 20, are provided paired discharge rollers 21 for temporarily discharging the sheet S to a temporary retaining tray 23, and a discharge sensor 22 for detecting the sheet S that is discharged. A sheet re-supplying unit 34, which is located in the vicinity of the discharge sensor 22, temporarily holds the sheets S that are fed to that location after images are formed on them, and sequentially re-supplies them.

The temporary retaining tray 23 is inclined, so as to assist the sheets S to reach a re-supply separation belt 33. A re-supply roller 31 is provided near the distal end of the tray 23, and downstream, the roller 31, a transportation roller 32 and the separation belt 33 for re-transportation abut each other, so that the sheets S can be fed individually.

A multi-flapper 36 is located near the transportation roller 32 and the separation belt 33, and downstream of the multi-flapper 36, provided so that it extends upward, is an inversion path 37, along which the image forming face of the sheet S is inverted for multiple printing, and extending downward is provided a transportation path 39 along which are paired feeding rollers 40*a*, 40*b*, 40*c* and 40*d* by which the sheets S are again transported to the image forming unit 7.

Sensors 50, 51, 52, 53, 54, 55, 56, 57 and 58 are located along the above described paths to detect the passage of the sheets S.

Figure 2:
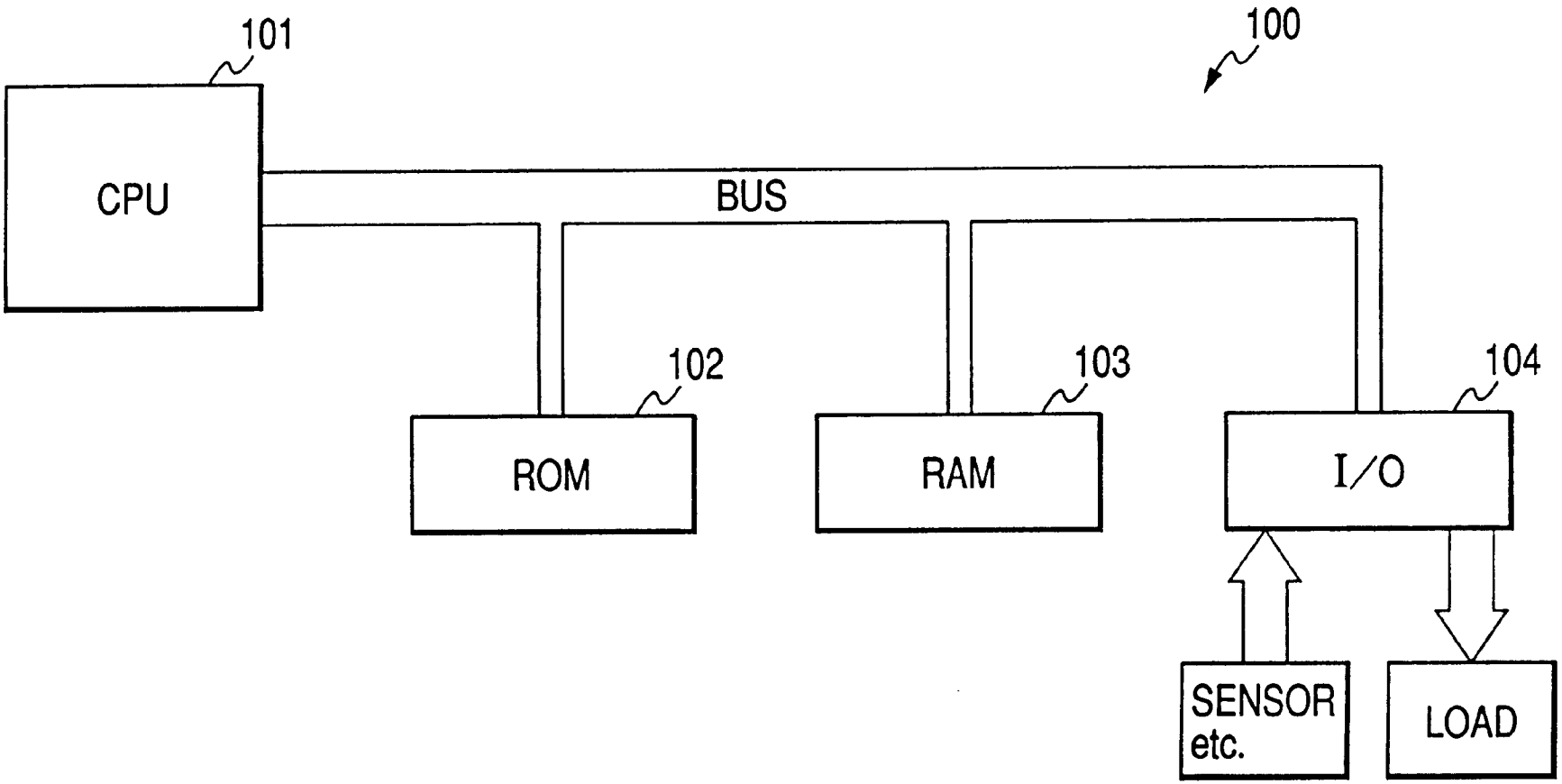
FIG. 2 is a block diagram illustrating a controller.

FIG. 2 is a block diagram illustrating a controller 100 according to this embodiment. The controller 100 comprises a CPU 101 for controlling the copying machine according to control procedures stored in a read only memory (ROM) 102; the ROM 102 in which are stored the control procedures (a control program) for the controller of the main body 3; a random access memory (RAM) 103, which is a main memory device used as an input data memory area or as a work memory area; and an interface (I/O) 104 for outputting a control signal to the CPU 101 for a load, such as a main motor, and for receiving signals from sensors and transmitting them to the CPU 101.

Signals from individual devices incorporated in, or connected to, the main body 3 are exchanged with the CPU 101 via the I/O 104.

Figure 3A:
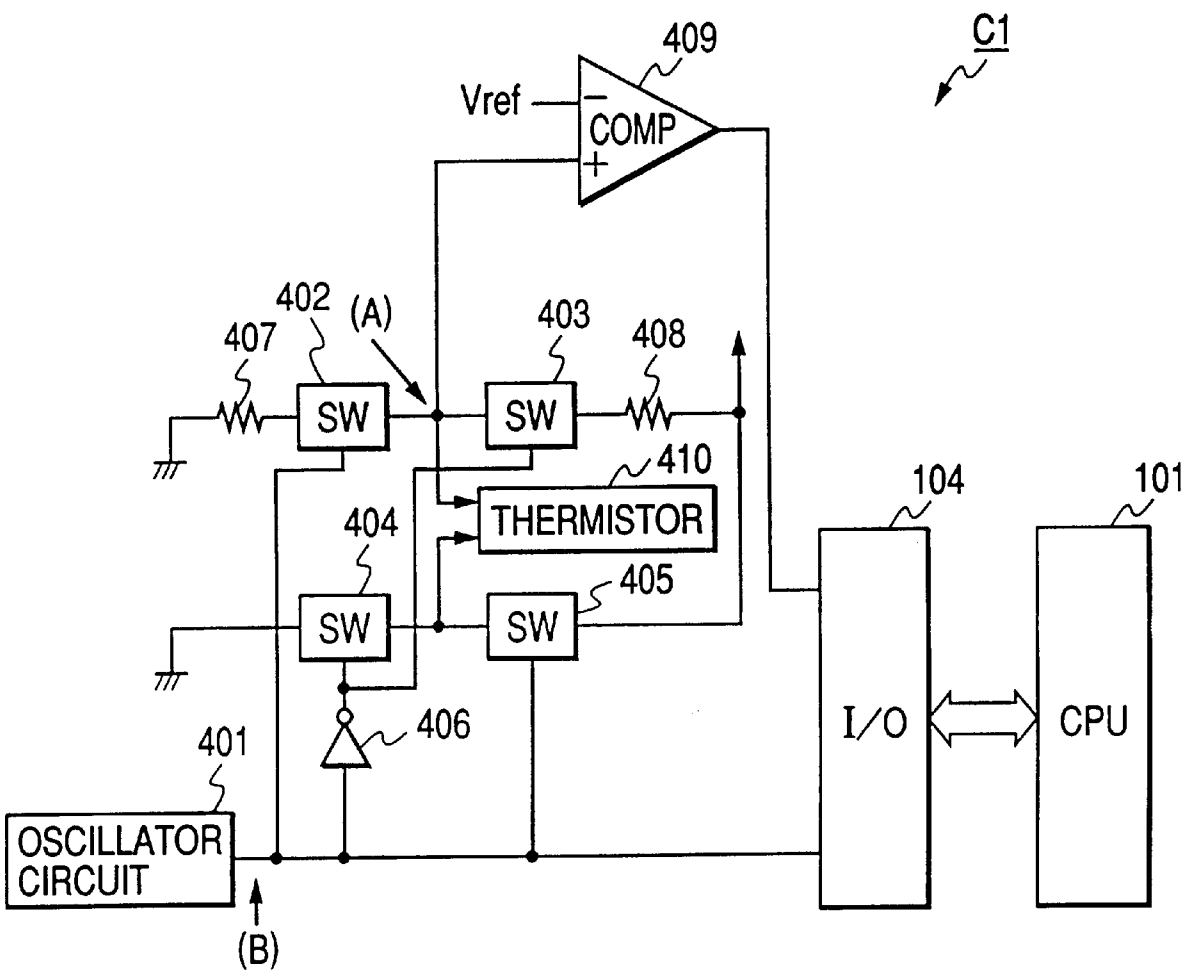
FIGS. 3A, 3B and 3C are schematic diagrams illustrating the arrangement of an abnormality supervision circuit.

FIG. 3A is a schematic diagram illustrating an abnormality supervision circuit C1 for managing a signal from a thermistor 410, which is so located that it can detect the temperature of the fixing roller 16*a* and which has a negative temperature coefficient. In the abnormality supervision circuit C1, switches 402, 403, 404 and 405 are turned on and off in accordance with the output of an oscillator circuit 401, and circuits to be connected to the thermistor 410 are changed.

Figure 3C:
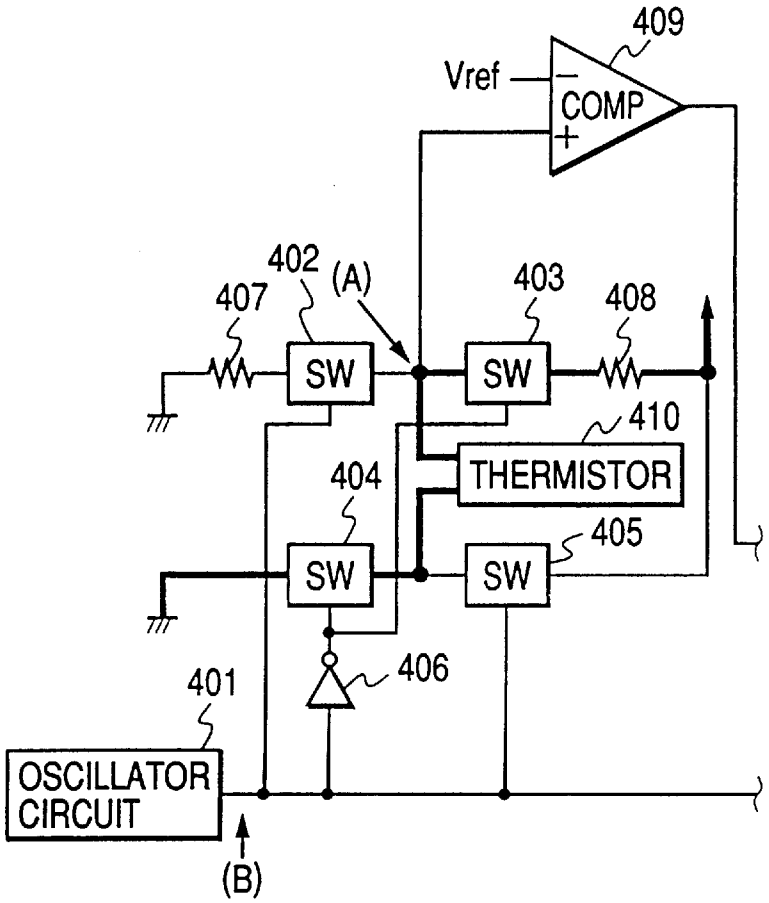
Figure 3B:
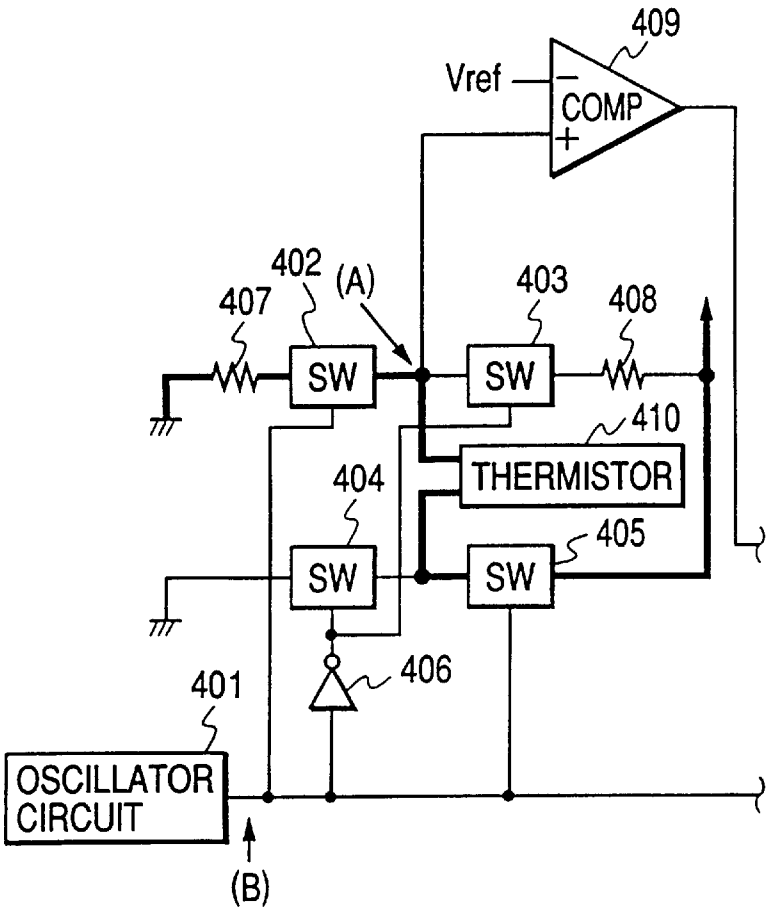

A rectangular wave having a predetermined frequency is output by the oscillator circuit 401, and when the output (point B) is at level "H," the switches 402 and 405 are turned on and the switches 403 and 404 are turned off. As a result, a circuit indicated by a thick solid line in FIG. 3B is selected. A resistor 407 is connected between the thermistor 410 and the ground, and a ground voltage (a voltage between the thermistor 410 and the resistor 407) is supplied as one of the signals transmitted from the thermistor 410 to a comparator 409, which serves as comparison means. This is the state for supervising the abnormal temperature rise at the thermistor 410.

When the output from the oscillator 401 is at level "L," the switches 403 and 404 are turned on and the switches 402 and 405 are turned off. As a result, a circuit indicated by a thick solid line in FIG. 3C is selected. A resistor 408 is connected between the thermistor 410 and the high voltage side, and a voltage on the high voltage side (a voltage between the thermistor 410 and the resistor 408) is supplied as the other signal from the thermistor 410 to the comparator 409, which serves as comparison means. This is the state for supervising the disconnection of the thermistor 410.

An inverter 406 inverts the phases of the switches 402 and 405, and 403 and 404. The signal output by the comparator 409 is transmitted via the I/O 104 to the CPU 101 to identify the abnormal state.

Figures 4A, 4B, 4C:
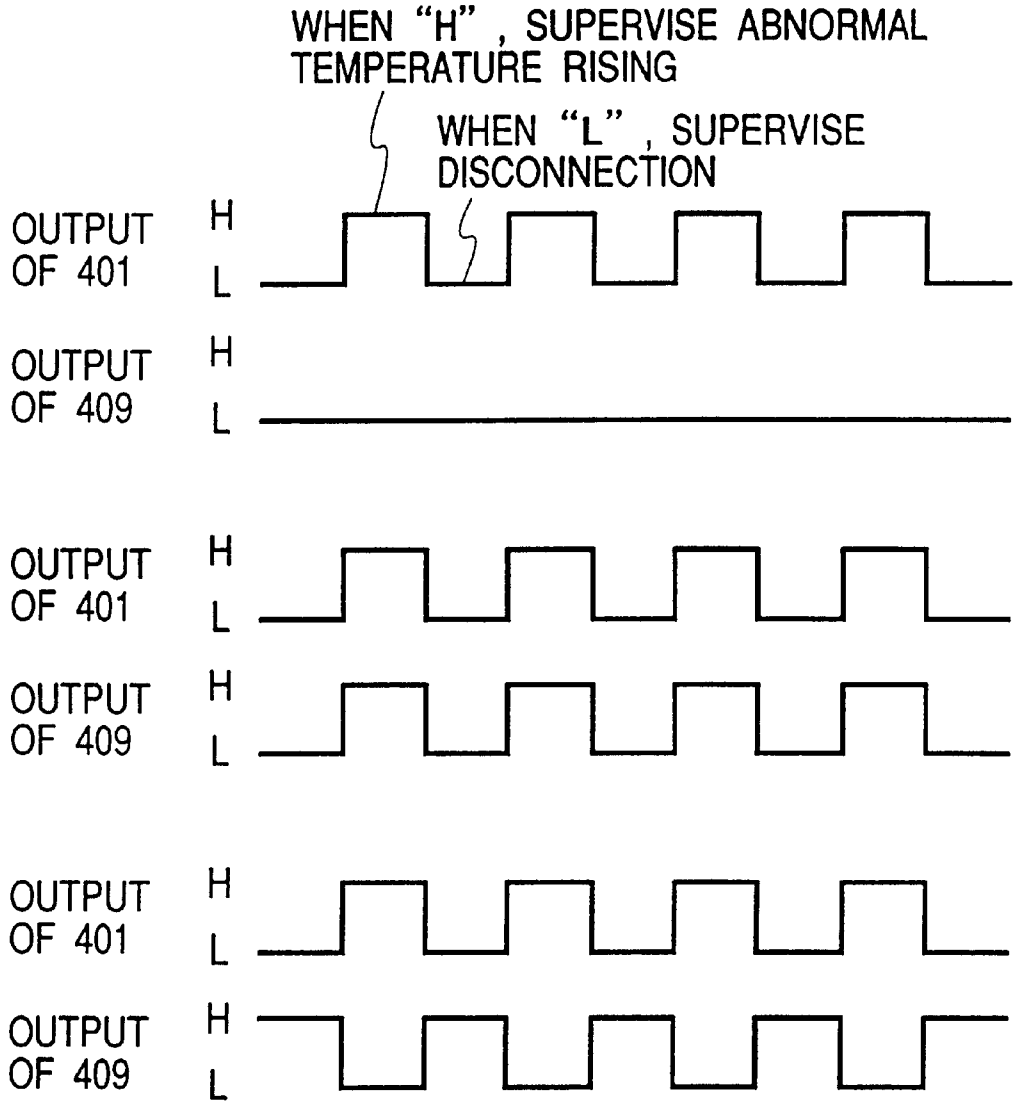
FIGS. 4A, 4B and 4C are diagrams showing signals output by an oscillator circuit and a comparator.

In FIGS. 4A to 4C are shown select signals (output levels H and L) generated by the oscillator circuit 401, and signals from the comparator 409 that correspond to a voltage at point A in a circuit selected in accordance with the select signals. FIG. 4A represents the signals during normal operation, FIG. 4B represents the signals at the time an abnormal temperature rises, and FIG. 4C represents the signals at the time of a disconnection.

During the normal operation, the voltage at point A is lower than Vref, and as is shown in FIG. 4A, the output of the comparator 409 is always at level "L".

When an abnormality (an abnormal temperature rise or a disconnection) occurs, the voltage at point A becomes higher than Vref, and as is shown in FIGS. 4B and 4C, a rectangular wave having the same frequency as that of the oscillator circuit 401 is output by the comparator 409. When its output goes to level "H," it is ascertained that the abnormality has occurred and the overall operation of the apparatus is halted and inhibited. When the output of the oscillator 401 at this time is at level "H," the abnormality is determined to be an abnormal temperature rise, and the power to the apparatus is shut off. When the output is at level "L," the abnormality is determined to be a disconnection, and the disconnection of the thermistor is displayed on a display (not shown).

Figure 5A:
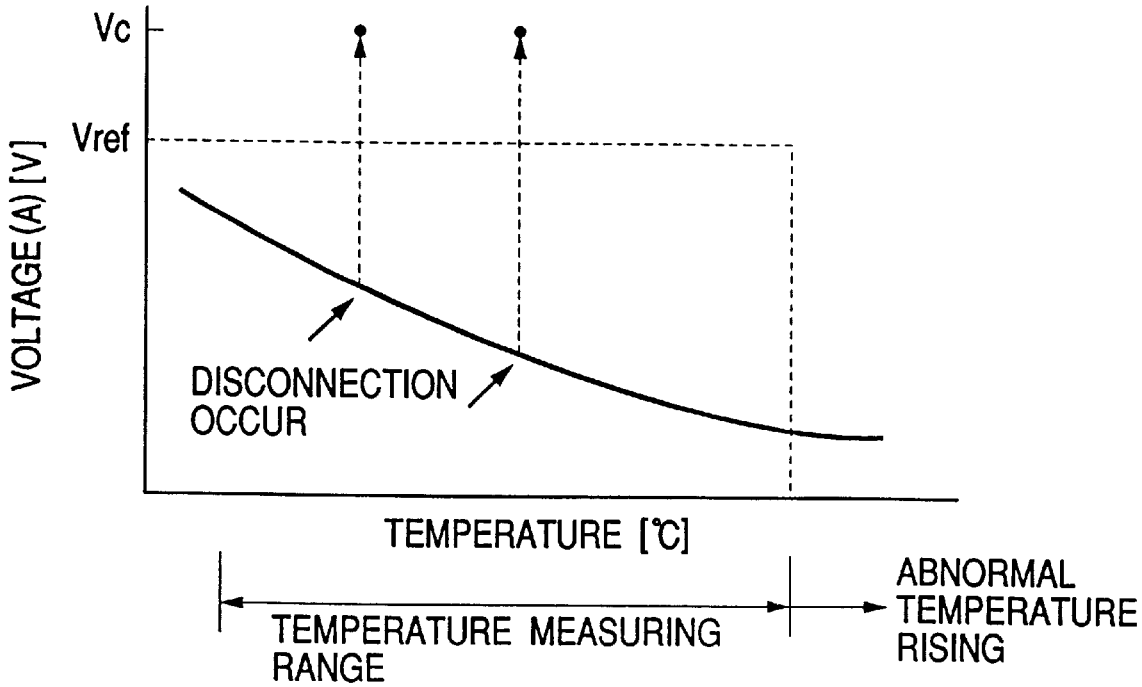
FIGS. 5A and 5B are graphs showing a change in a voltage of the abnormality supervision circuit at point A.
Figure 5B:
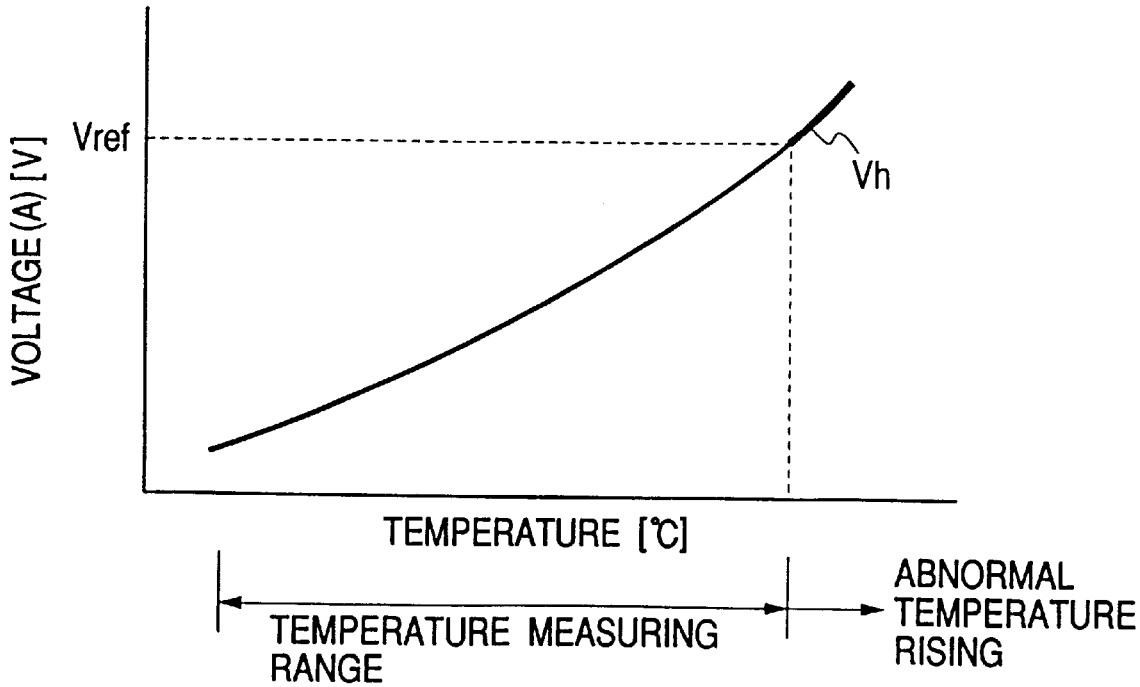

In FIGS. 5A and 5B are shown changes in a voltage at point A in the abnormality supervision circuit C1. FIG. 5A shows the change in a voltage relative to the temperature when the output (point B) of the oscillator circuit 401 is at level "L," i.e., when a disconnection of the thermistor 410 is managed. FIG. 5B shows the change in a voltage relative to the temperature when the output (point B) of the oscillator circuit 401 is at level "H," i.e., when the abnormal temperature rise of the thermistor 410 is managed. According to these graphs, the voltage applied to the comparator 409 exceeds Vref upon the occurrence of either abnormality (Vc in FIG. 5A and Vh in FIG. 5B), and the output of the comparator 409 becomes a rectangular wave having the same frequency as that of the oscillator circuit 401, thereby resulting in the shutoff.

Figure 6:
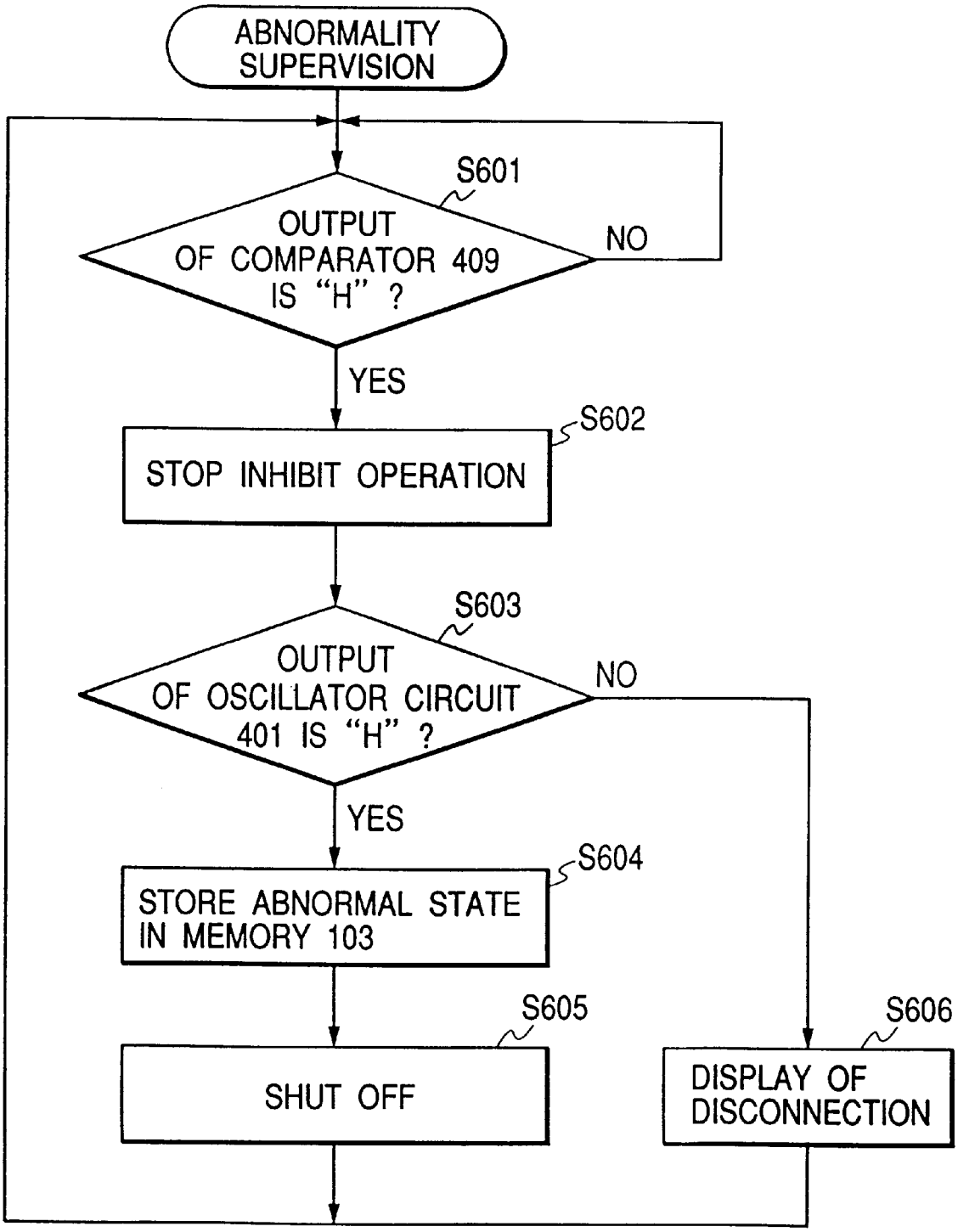
FIG. 6 is a flowchart showing an abnormality supervision process.

FIG. 6 is a flowchart showing the abnormality supervision processing. When the output of the comparator 409 is determined to be at level "H" (S601), the overall operation of the apparatus is halted and further operation is inhibited (S602). If the output of the oscillator circuit 401 at this time is at level "H," it is ascertained that an abnormal temperature rise has occurred, while if the output of the oscillator circuit 401 is at level "L," it is ascertained that a disconnection has occurred (S603). When an abnormal temperature rise has occurred, the hysteresis of -the occurrence of the abnormal temperature rise is stored in the memory 103 (S604), and power to the apparatus is shut off (S605). When a disconnection has occurred, the disconnection of the thermistor 410 is displayed on the display (S606).

[Second Embodiment]

Figure 7:
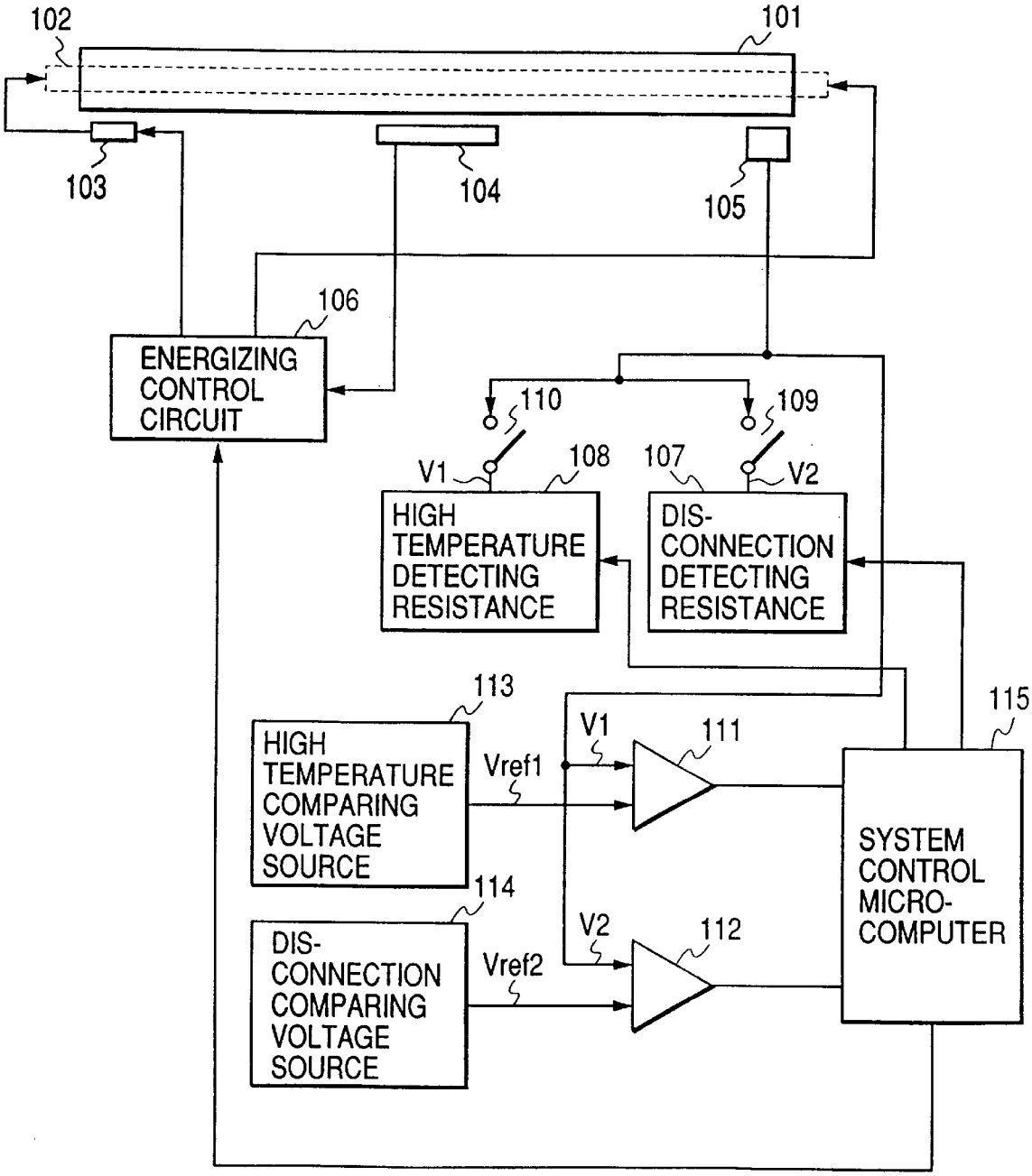
FIG. 7 is a block diagram illustrating an image forming apparatus according to a second embodiment of the present invention.

FIG. 7 is a block diagram illustrating an image forming apparatus according to a second embodiment of the present invention. Although not shown in FIG. 7, a charger, a photosensitive drum, a toner developer, and a transportation unit for a recording medium are incorporated in the image forming apparatus.

A halogen heater 102 is provided for a fixing roller 101. A temperature switch 103, connected in series with the halogen heater 102, is connected to a heater controller 106. A temperature control thermistor 104, located opposite the center of the fixing roller 101, detects the temperature of the fixing roller 101 and transmits a detected temperature signal to the heater controller 106. In consonance with the detected temperature signal, the heater controller 106 energizes the halogen heater 102 in order to obtain an appropriate temperature for toner fixing. The above described arrangement is provided for a conventional temperature controller.

A thermistor 105, a novel component provided for the present invention, is located opposite a non-paper passing portion near the right end of the fixing roller 101 and separated from the fixing roller 101 by a predetermined interval. The recording medium does not pass across the non-paper passing portion, but passes across a portion close to the center. The temperature at the non-paper passing portion varies depending on the size of the recording medium, in the axial direction of the fixing roller 101, that is passed across the fixing roller 101 to fix an image thereon, i.e., the temperature depends on the passing position. The thermistor 105 serves as a safety countermeasure means for detecting an abnormality in the thermistor 105 itself. The thermistor 105 is a well known variable impedance element for which the impedance is a negative temperature coefficient, and has an impedance characteristic consonant with the temperature. One end at the thermistor 105 is connected to a common connection point, which is the upper end of switches (SW) 109 and 110, and the other end is connected, for example, to one end of a power source (not shown).

Figure 8:
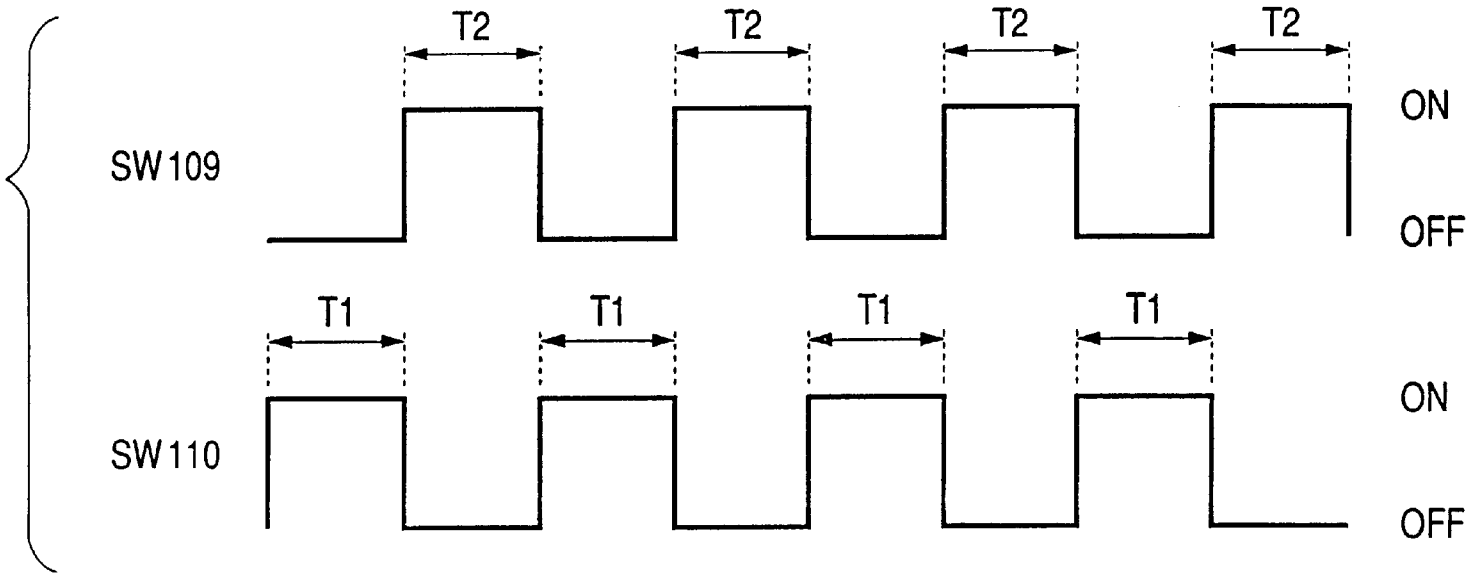
FIG. 8 is a timing chart for checking on a disconnection and a high temperature according to the second embodiment.

The switch 109 is a disconnection switch, and is connected at its lower end to a disconnection detection resistor 107. The switch 110 is a high temperature detection switch and is connected to a high temperature detection resistor 108. The resistors 107 and 108, which are constant impedance elements whose impedances differ, are connected at their lower ends to the other end of the above mentioned power source, and are so located that they are little affected by changes in the temperature of the fixing roller 101. The temperature coefficients of the resistors 107 and 108 are small, positive values. A system control microcomputer 115 controls the opening and closing of the switches 109 and 110 in response to the receipt of switching signals, and the switches 109 and 110 are alternately turned on and off in accordance with a timing chart shown in FIG. 8.

As a result, the thermistor 105 and the switch 109 or 110 are alternately connected in series with the power source, and power is supplied to the series circuits constituted by the disconnection detection resistor 107 or the high temperature detection resistor 108 and the thermistor 105. Then, a detection voltage V1, which is a first electric parameter in consonance with a first voltage division ratio of a reading for the thermistor 105 to a reading for the high temperature detection resistor 108, and a detection voltage V2, which is a second electric parameter in consonance with a second voltage division ratio of the reading for the thermistor 105 to the reading for the high temperature detection resistor 108, are produced. The detection voltage V1 is alternately generated during the switch 110 ON time T1 in FIG. 8, and the detection voltage V2 is generated during the switch 109 ON time T2. During time T1 an abnormal high temperature at the fixing roller 101 is detected, based on the detection voltage V1, and during time T2 an abnormality at the thermistor 105 due to a disconnection is detected, based on the detection voltage V2.

Specifically, during the abnormal high temperature checking time T1, a high temperature comparator 111 compares the detection voltage V1 with reference voltage Vref1, supplied by a high temperature comparison power source 113. During the disconnection checking time T2, a disconnection comparator 112 compares the detection voltage V2 with reference voltage Vref2, supplied by a disconnection comparison power source 114. The reference voltages Vref1 and Vref2 are specific values that are determined in advance. When the detection voltage V1 exceeds the reference voltage Vref1, the impedance at the thermistor 105 is low due to a high temperature. When the detection voltage V2 is lower than the reference voltage Vref2, the impedance at the thermistor 105 is high due to the occurrence of a disconnection.

As is described above, according to the second embodiment, in addition to the temperature control thermistor 104 the thermistor 105 is provided for the fixing roller 101, and changes in the impedance at the thermistor 105 are detected by using the detection voltages V1 and V2. Therefore, an abnormal temperature rise at the end of the fixing roller 101 and a disconnection of the thermistor 105 can be identified, and a high temperature at the fixing roller, which is caused an abnormal temperature adjustment of the temperature control thermistor 104, can be precisely detected. The arrangement in this embodiment is not advantageous for the temperature control for the fixing roller 101. However, since the temperature is detected at the non-paper passing portion to protect a delicate thermistor, and the detection of the temperature of the fixing roller 101 and the detection of a disconnection of the thermistor 105 are performed alternately and continuously, the energization of the heater can be halted more quickly than it can by using the temperature switch 103 (or a temperature fuse) to respond to the occurrence of an operational failure and an abnormal temperature rise at the temperature control thermistor 104 of the fixing roller 101.

[Third Embodiment]

Figure 9:
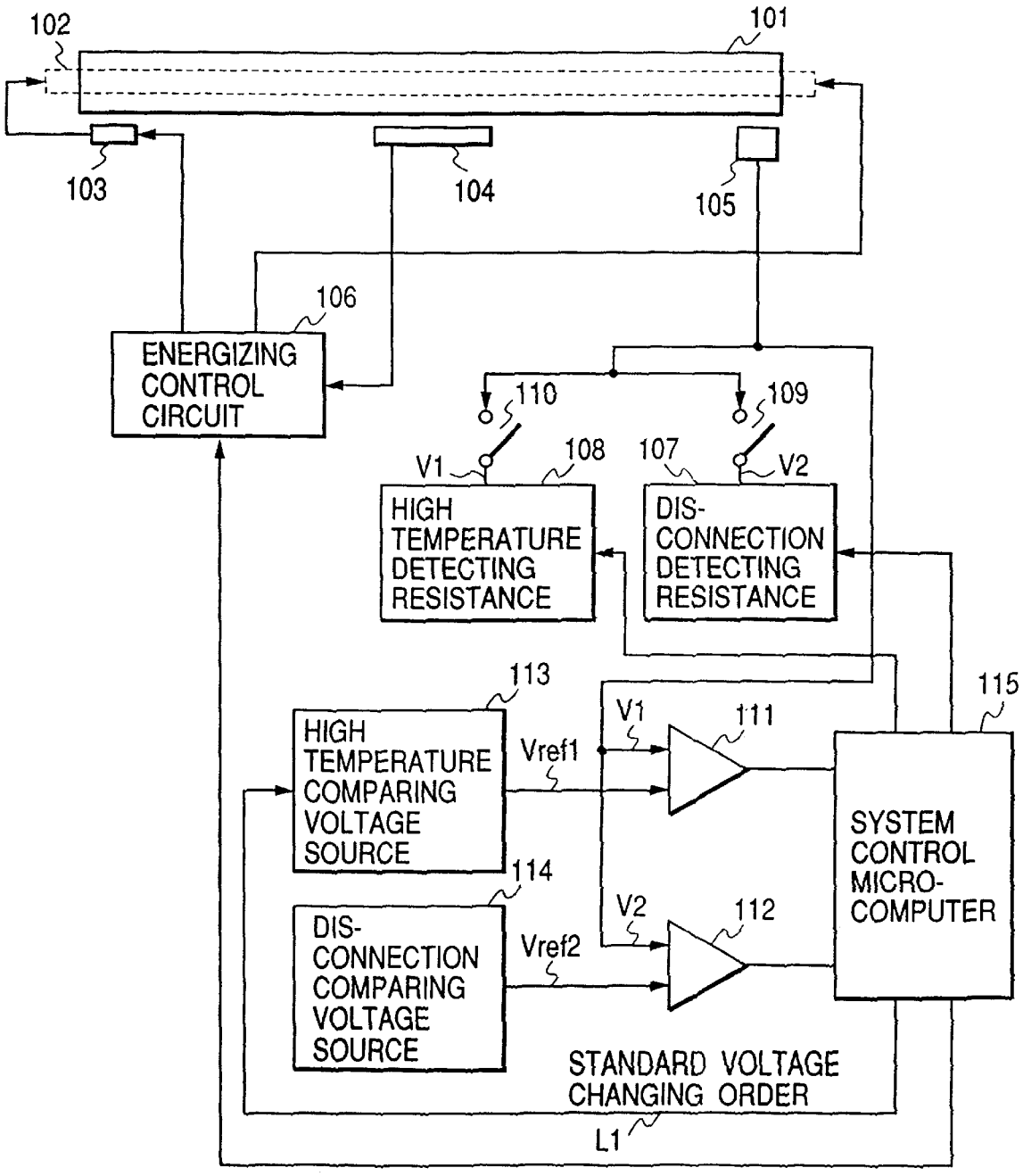
FIG. 9 is a block diagram illustrating an image forming apparatus according to a third embodiment of the present invention.

FIG. 9 is a block diagram illustrating an image forming apparatus according to a third embodiment of the present invention. Although not shown in FIG. 9, the image forming apparatus also incorporates a charger, a photosensitive drum, a toner developer and a transportation unit for a recording medium. In addition to the arrangement in FIG. 7, a signal line L1 is provided along which a reference voltage Vref1, supplied by a high temperature comparison power source 113, is changed by a system control microcomputer 115 in consonance with the size of a recording medium in the axial direction of a fixing roller 101.

During a high temperature checking time T1 in which a high temperature switch 110 is closed, the reference voltage Vref1 of the high temperature comparison power source 113, which is to be compared with a detection voltage V1 determined by using a voltage division ratio of a reading for a high temperature detection resistor 108 to a reading for a thermistor 105, is changed.

Figure 10:
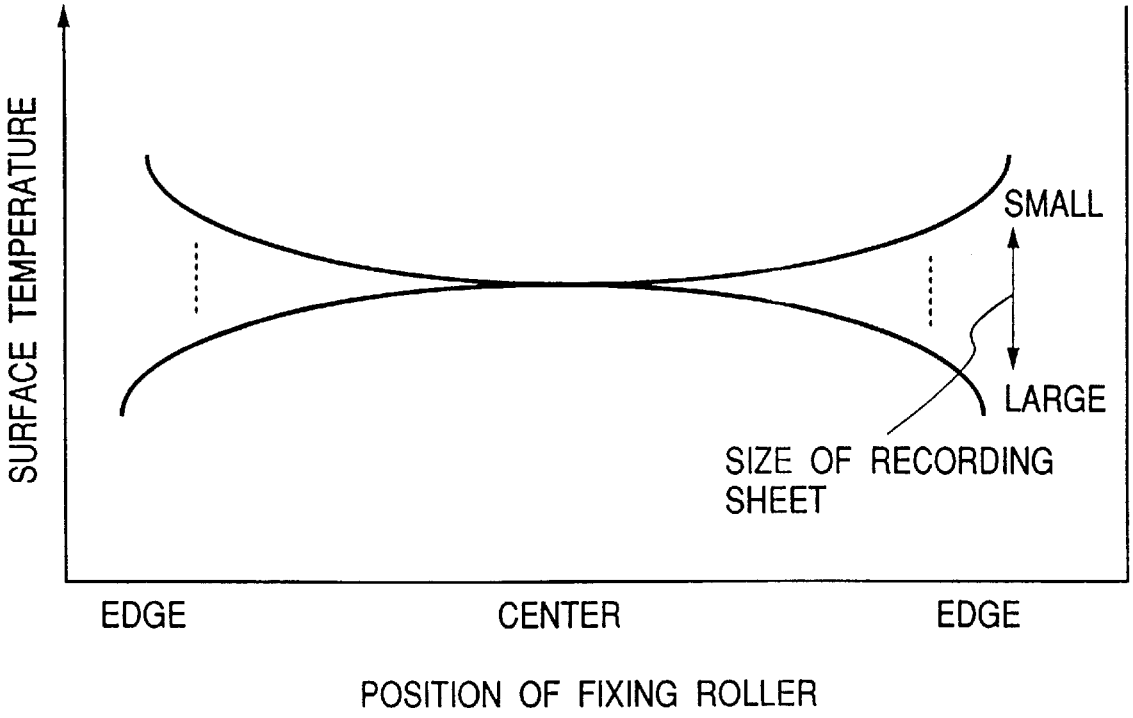
FIG. 10 is a characteristic graph showing surface temperature distribution of a fixing roller relative to the size of a recording sheet in the axial direction of the fixing roller.

FIG. 10 is a characteristic graph showing a surface temperature distribution for the fixing roller 101 relative to the size of a recording medium in the axial direction of the fixing roller 101.

That is, when the recording medium is large in the axial direction of the fixing roller 101, the temperature does not rise at the end of the fixing roller 101, and the reference voltage Vref1 is set low. When the recording medium is small in the axial direction of the fixing roller 101, there is a drastic rise in the temperature at the end of the fixing roller 101, and the reference voltage Vref1 is changed to high.

As is described above, according to this embodiment, in addition to obtaining the same effect as is acquired by the second embodiment, since the difference in the temperatures between the center and the end of the fixing roller is corrected by changing the reference voltage Vref1 in consonance with the size of the recording sheet, during the fixing process for a small sheet an erroneous detection due to a temperature rise at the end of the fixing roller can be prevented in the normal image forming operation, and the accuracy of the detection of the temperature can be increased.

[Fourth Embodiment]

Figure 11:
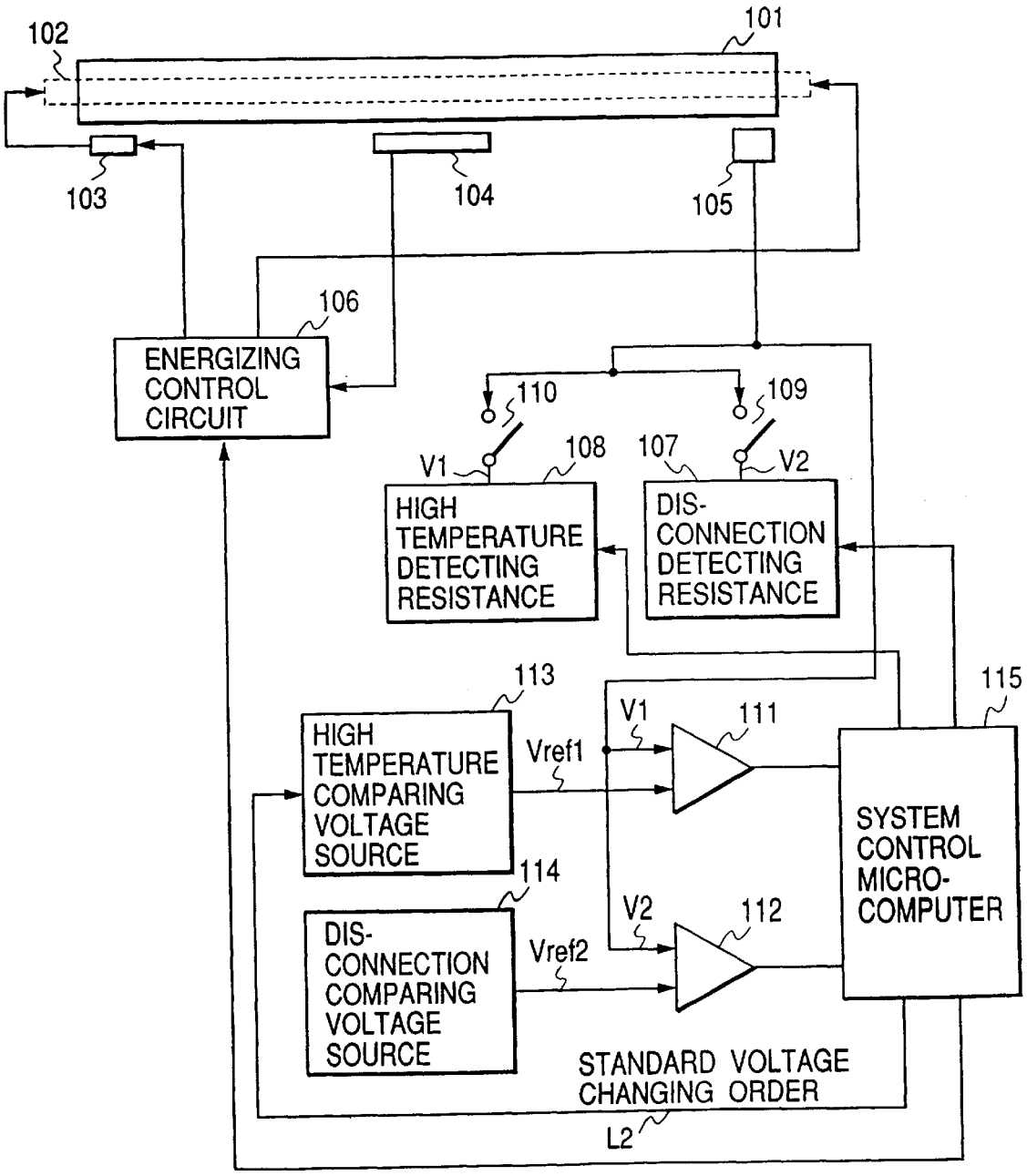
FIG. 11 is a block diagram illustrating an image forming apparatus according to a fourth embodiment of the present invention.

FIG. 11 is a block diagram illustrating an image forming apparatus according to a fourth embodiment of the present invention. Although not shown in FIG. 11, the image forming apparatus also incorporates a charger, a photosensitive drum, a toner developer and a transportation unit for a recording medium. In addition to the arrangement in FIG. 7, a signal line L2 is provided along which a reference voltage Vref1, supplied by a high temperature comparison power source 113, is changed by a system control microcomputer 115 in consonance with the number of recording sheets that have passed over a fixing roller 101 within a predetermined period of time.

During a high temperature checking time T1 in which a high temperature switch 110 is closed, the reference voltage Vref1 of the high temperature comparison power source 113, which is to be compared with a detection voltage V1 determined by using a voltage division ratio of a reading for a high temperature detection resistor 108 to a reading for a thermistor 105, is changed.

Figure 12:
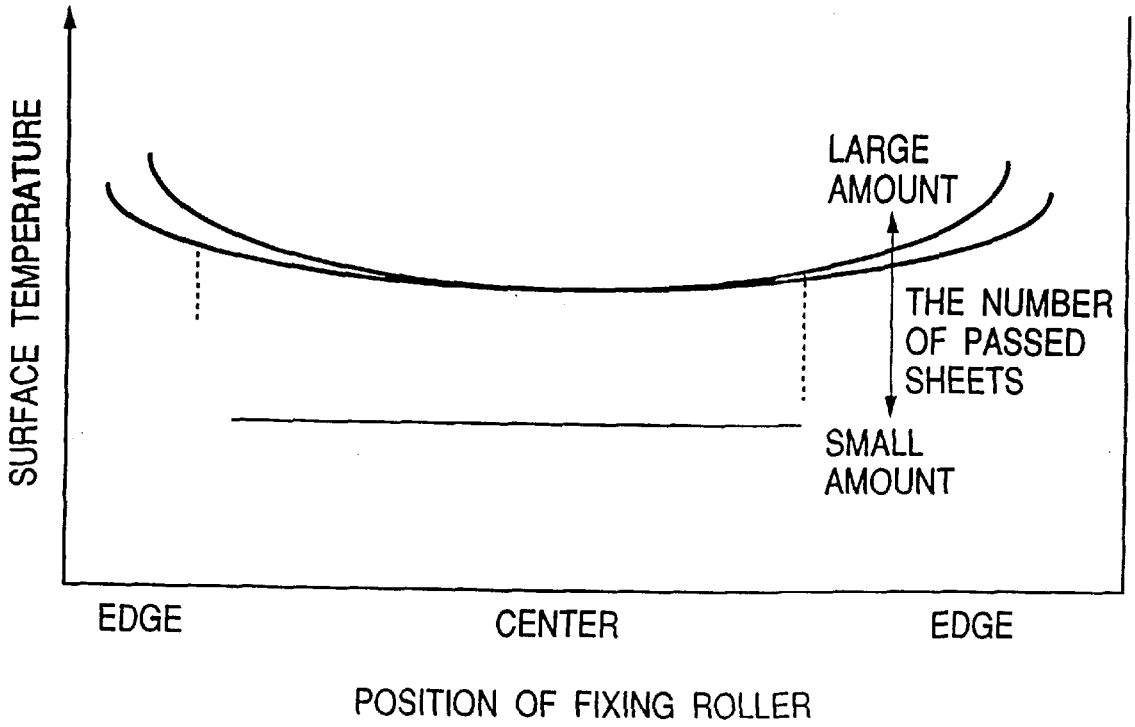
FIG. 12 is a characteristic graph showing surface temperature distribution for a fixing roller relative to the number of sheets when pass over the fixing roller within a predetermined period of time.

FIG. 12 is a characteristic graph showing a surface temperature distribution for the fixing roller 101 relative to the number of recording sheets that have passed over the fixing roller 101 within a predetermined period of time.

That is, while the temperature at the end of the fixing roller 101 does not rise much when only a few recording sheets have passed in a predetermined time period, there is a drastic rise in the temperature at the end of the fixing roller 101 when many recording sheets have passed in the predetermined time period. Therefore, for the printing of many sheets, the output reference voltage Vref1 of the high temperature comparison power source 113 is set higher than it is for the printing of only a few sheets.

As is described above, according to this embodiment, in addition to obtaining the same effect as is acquired by the second embodiment, the influence exerted on the temperature can be corrected for since the influence varies depending on the number of recording sheets that are to be sequentially printed in a predetermined period of time. In addition, an erroneous temperature detection, which occurs as a result of a temperature rise at the end of the fixing roller 101 during the fixing process for a small recording medium, can be precisely prevented.

In the above described embodiments, the detection voltages V1 and V2 are produced through voltage division by the thermistor 105 and the resistors 107 and 108. However, a current consonant with a change in the impedance of the thermistor 105 may be detected. For example, the thermistor 105 and the switches 109 and 110 are connected in parallel to the power source; constant impedance elements are connected to the switches 109 and 110; a current is alternately supplied by the power source to the parallel circuits constituted by the thermistor 105 and the constant impedance elements; a first detection current, which corresponds to a first current division ratio of the reading for the thermistor 105 to the impedance of the first impedance element, and a second detection current, which corresponds to a second current division ratio of the reading for the thermistor 105 to the impedance of the second impedance element, are produced and individually compared with a reference value.

In the first embodiment, the same value is employed for the reference for the detection of a temperature rise and the reference for the detection of a disconnection. These reference values may differ as in the second to the fourth embodiments.

The present invention is not limited to the above described embodiments, and various modifications are possible within the scope of claims.

What is claimed is:

1. An energization control apparatus comprising:

fixing means having a heater for using heat to fix a transferred toner image to a recording sheet;

temperature detection means, having an impedance which varies in consonance with a temperature, for detecting a temperature of said fixing means;

selection means for alternately selecting a first resistor having a first impedance and a second resistor having a second impedance for connection to said temperature detection means; and abnormality detection means for, when said first resistor is connected to said temperature detection means by said selection means, comparing a value, which is determined from said first resistor and an impedance of said temperature detection means, with a predetermined value to detect a malfunction of said temperature detection means, and for, when said second resistor is connected to said temperature detection means by said selection means, comparing a value, which is determined from said second resistor and said impedance of said temperature detection means, with said predetermined value to detect a malfunction of said fixing means.

2. An energization control apparatus according to claim 1, wherein said selection means includes oscillation means for generating a select signal.

3. An energization control apparatus according to claim 1, wherein said temperature detection means is a thermistor having a negative temperature coefficient.

4. An energization control apparatus according to claim 1, wherein said temperature detection means is provided outside an area through which said recording sheet is passed.

5. An energization control apparatus comprising:

a heating element;

energization control means for controlling energization of said heating element;

a fixing unit for fixing a transferred toner image to a recording sheet using heat generated by said heating element;

a variable impedance element having an impedance characteristic consonant with a temperature and being located opposite said fixing unit;

switching means for connecting one of first and second fixed impedance elements to said variable impedance element;

generation means for generating one of a first parameter, which is determined by said variable impedance element and said first fixed impedance element, and a second parameter, which is determined by said variable impedance element and said second fixed impedance element, according to a connection state of said switching means;

first comparison means for comparing said first parameter produced by said generation means with a first reference value that indicates an abnormality at said variable impedance element;

second comparison means for comparing said second parameter produced by said generation means with a second reference value that indicates an abnormal temperature at said fixing unit; and energization stop means for halting, in accordance with results obtained by said first and said second comparison means, the energization at said heating element by said energization control means.

6. An energization control apparatus according to claim 5, wherein said generation means changes said second reference value in consonance with the size of said recording sheet that passes said fixing unit.

7. An energization control apparatus according to claim 6, wherein said generation means reduces said second reference value when said recording sheet that passes said fixing unit is large.

8. An energization control apparatus according to claim 5, wherein said generation means changes said second reference value in consonance with the number of recording sheets that pass said fixing unit within a predetermined period of time.

9. An energization control apparatus according to claim 8, wherein said generation means reduces said second reference value when the number of recording sheets that pass through said fixing unit within a predetermined period of time is increased.

10. An energization control apparatus according to claim 5, wherein said first parameter is a voltage that corresponds to a voltage division ratio of a reading for said variable impedance element to a reading for said first fixed impedance element, and said second parameter is a voltage that corresponds to a voltage division ratio of a reading for said variable impedance element to a reading for said second fixed impedance element.

11. An energization control apparatus according to claim 5, wherein said first parameter is a current that corresponds to a current division ratio of a reading for said variable impedance element to a reading for said first fixed impedance element, and said second parameter is a current that corresponds to a current division ratio of a reading for said variable impedance element to a reading for said second fixed impedance element.

12. An energization control apparatus according to claim 6 or 8, wherein said variable impedance element is located at a portion of said fixing unit whereat a recording sheet does not pass.

13. An energization control apparatus according to claim 5, wherein said variable impedance element is a thermistor having a negative temperature coefficient.

14. An energization control apparatus comprising:

a heating element;

energization control means for controlling energization of said heating element;

an object to be heated by said heating element;

temperature detection means, having an impedance which varies in consonance with a temperature, for detecting the temperature of said object;

switching means for selectively connecting one of first and second resistors having different impedances to said temperature detection means; and abnormality detection means for, in consonance with a connection condition established by said switching means, distinguishably detecting a malfunction of said heating element and an abnormal temperature of said object to be heated.

* * * * *

UNITED STATES PATENT AND TRADEMARK OFFICE

CERTIFICATE OF CORRECTION

PATENT NO. : 6,097,904

DATED : August 1, 2000

INVENTOR(S) : KUNIO TSURUNO, ET AL.

It is certified that error appears in the above-identified patent and that said Letters Patent is hereby corrected as shown below:

Column 4

Line 9, "above described" should read --above-described--.

Column 5

Line 41, "-the" (second occurrence) should read --the--.
Line 62, "above described" should read --above-described--.

Column 6

Line 24, "above described" should read --above-described--.

UNITED STATES PATENT AND TRADEMARK OFFICE

CERTIFICATE OF CORRECTION

PATENT NO. : 6,097,904

DATED : August 1, 2000

INVENTOR(S) : KUNIO TSURUNO, ET AL.

It is certified that error appears in the above-identified patent and that said Letters Patent is hereby corrected as shown below:

Column 7

Line 9, "caused" should read --caused by--.

Column 8

Line 41, "above described" should read --above-described--.

Line 65, "above" should read --above- --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*